US006158967A

United States Patent [19]

Dupré

[11] Patent Number: 6,158,967

[45] Date of Patent: Dec. 12, 2000

[54] BARRIER FLUID SEAL, RECIPROCATING PUMP AND OPERATING METHOD

[75] Inventor: Milburn Emile Dupré, Orange, Tex.

[73] Assignee: Texas Pressure Systems, Inc., Orange, Tex.

[21] Appl. No.: 09/309,840

[22] Filed: May 11, 1999

Related U.S. Application Data

[60] Provisional application No. 60/097,903, Aug. 26, 1998.

[51] Int. Cl.[7] ..... F04B 17/00

[52] U.S. Cl. ..... 417/53; 417/404; 277/1; 277/304

[58] Field of Search ..... 137/72; 417/53, 417/259, 365, 377, 379, 393, 12, 375, 403, 404; 91/50; 267/64.1; 166/305.1; 277/3, 1, 304

[56] References Cited

U.S. PATENT DOCUMENTS

| | | | |
|---|---|---|---|
| 3,516,760 | 6/1970 | Dettinger | 417/53 |
| 3,704,506 | 12/1972 | Milsted, Sr. | 137/72 |
| 4,013,385 | 3/1977 | Peterson | 417/377 |
| 4,166,410 | 9/1979 | Schlosser | 91/50 |
| 4,353,683 | 10/1982 | Clark | 417/379 |
| 4,477,232 | 10/1984 | Mayer | 417/342 |
| 4,552,344 | 11/1985 | Johnson | 267/64.11 |
| 4,569,396 | 2/1986 | Brisco | 166/305.1 |
| 4,575,315 | 3/1986 | Galais et al. | 417/365 |
| 4,681,516 | 7/1987 | O'Hara et al. | 417/259 |
| 4,708,601 | 11/1987 | Bazan et al. | 417/393 |
| 4,710,104 | 12/1987 | Dring | 417/53 |
| 5,052,694 | 10/1991 | Lipschitz | 277/3 |
| 5,222,867 | 6/1993 | Walker, Sr. et al. | 417/12 |
| 5,533,867 | 7/1996 | Strenzke | 417/53 |
| 5,651,666 | 7/1997 | Martin | 417/375 |
| 5,746,435 | 5/1998 | Arbuckle | 271/1 |
| 5,769,427 | 6/1998 | Ostrowski | 277/3 |
| 5,860,795 | 1/1999 | Ridley et al. | 417/403 |
| 5,906,374 | 5/1999 | Arbuckle | 277/304 |
| 5,971,714 | 10/1999 | Schaffer et al. | 417/44.2 |

*Primary Examiner*—Teresa Walberg
*Assistant Examiner*—Leonid Fastovsky
*Attorney, Agent, or Firm*—Akin, Gump, Strauss, Hauer & Feld, LLP

[57] ABSTRACT

A barrier fluid seal assembly is provided for a reciprocating rod, where the reciprocation of the rod is used to pump barrier fluid through a barrier fluid chamber. The rod has first and second seals, and the barrier fluid chamber is located between the seals. Barrier fluid pressure is maintained higher than process fluid pressure so that if there is leakage past the seals, then it is barrier fluid that leaks, which keeps the seals clean and flushed. A reciprocating pump may incorporate the barrier fluid seal assembly for sealing around a plunger. A method of operating first and second reciprocating pumping cylinders provides bumpless transfer of pumping from one pumping cylinder to the other pumping cylinder. Motion controls, such as a controller using a position transducer for a hydraulic piston and a servo-valve for providing hydraulic fluid to the hydraulic piston, are used to compress liquid process fluid in one pumping cylinder prior to beginning its pumping stroke. A total plunger speed is determined for plungers in pumping cylinders A and B, and total plunger speed is held essentially constant prior to hand-off of pumping from one pumping cylinder to another pumping cylinder. The speed of one plunger is increased before it enters its pumping stroke while the speed of the other plunger is decreased an equal amount as it reaches the end of its pumping stroke.

41 Claims, 8 Drawing Sheets

P
156
158
154
154a
154b
160
162
164
166a
166b
168
170a
170b
172a
172b
150a
150b
151a
151b
152a
152b
176
178a
178b
180a
180b
182a
182b
184a
184b
186a
186b
188
188p
190
192a
192b
194a
194b
196a
196b
198a
198b
202
202a
202b
204
206
210
210a
210b
212
214
216
218a
218b
220a
220b
230a
230b
232a
232b
A
B

```
P1=Input 320                    ;Discharge pressure in process fluid discharge line 188 (Fig.3)
P2=Input 322                    ;Barrier fluid pressure
P3(A)=Input 324                 ;Hydraulic cylinder pressure in pumping cylinder A (Fig.3)
P3(B)=Input 326                 ;Hydraulic cylinder pressure in pumping cylinder B (Fig.3)
P4=Input 308                    ;Barrier fluid pressure setpoint
PP(A)=Input 328                 ;Plunger position cylinder A
PP(B)=Input 330                 ;Plunger position cylinder B
PV(A)=Input 340                 ;Plunger velocity cylinder A
PV(B)=Input 342                 ;Plunger velocity cylinder B
VS=Output 346                   ;Barrier fluid pump speed
SV(A)=Output 348                ;Servo control loop for cylinder A
SV(B)=Output 350                ;Servo control loop for cylinder B
FLOW=Input 332                  ;Flow setpoint for process fluid in line 188 (Fig.3)
SW=Input 318                    ;Run-stop indication

1   if SW=true then 10 else 99
    if automode=true then 10 else 200
10  Startmotor1 = true          ;Start electric motor for barrier fluid pump (not shown)
    Startmotor2 = true          ;Start electric motor 156 (Fig.3)
    PV=FLOW/(plunger area)      ;Set plunger velocity setpoint
15  if P2<1.1*P4<1.15*P1 then 30 else 20
20  P2 ..PID.. VS               ;Start barrier fluid pressure control loop (different barrier fluid pump in
                                Fig.3)
```

FIG.6A

TO FIG.6B

FROM FIG.6A

FIG.6B

```
    Alarm: barrier fluid seal pressure; low barrier
    fluid pressure alarm
    goto 15
30  PV(A) ..PID ..SV(A)                    ;Cylinder A velocity control initiated straight PID control
40  P3(B) ..RAMP1 ..SV(B)                  ;Cylinder B pre-loading starts-increase pressure of hydraulic fluid
    if P3(B) > 0.97*P1 then 40 else 50     ;Check pre-load to jump to crawl, but need to take pressure amplification
                                           into account
50  P(3)B ..CRAWL..SV(B)                   ;Jump into crawl at 97% of pressure
    P3(B)new=P3(B)                         ;Check for pressure stabilization in hydraulic cylinder
    if P3(B)new-P3(B)<noise then 60 else 50
60  if PP(A)<95% then 70 else 80           ;Check for plunger A near end of stroke
70  PV(B) ..CRAWL..SV(B)                   ;Put plunger B in crawl waiting for A at end of stroke
    PV(A)+PV(B) ..PID..SV(A)               ;servo A PID accounts for B's additional flow
    goto 60
80  PV(A) ..RAMP2-..SV(A)                  ;A & B hand off at end of stroke on cylinder A-ramp speed of plunger A
                                           down while ramping up speed of plunger B
    PV(B) ..RAMP2+..SV(B)
    if PV(A)<0.01% of PV(B) then 90 else 80 ;Is plunger A stopped at end of stroke?
90  PV(B) ..PID..SV(B)                     ;Cylinder B pumps straight on PID control
    PV(A) ..RETRACT..SV(A)                 ;Plunger A retracted by servo A
    if PP(A)<1% then 140 else 90
```

TO FIG.6C

FIG.6C

FROM FIG.6B

```
140  P3(A) ..RAMP1..SV(A)                          ;Cylinder A pre-loading starts, cycle repeats...
     if P3(A)>0.97*P1 then 140 else 150
150  P3(A)..CRAWL..SV(A)
     P3(A)new=P3(A)
     if P3(A)new-P3(A)<noise then 160 else 150
160  if PP(B)<95% then 170 else 180
170  PV(A)..CRAWL..SV(A)
     PV(B)+PV(A)..PID..SV(B)
     goto 160
180  PV(B)..RAMP2-..SV(B)
     PV(A)..RAMP2+..SV(A)
     if PV(B)<0.01% of PV(A) then 190 else 180
190  PV(B)..RETRACT..SV(B)
     goto 1
99   Startmotor1=false
     Startmotor2=false
     goto 1
200  (manual mode) straight pumping without
     smoothing controls at a constant flow setpoint,
     not shown here for simplicity.
```

BARRIER FLUID SEAL, RECIPROCATING PUMP AND OPERATING METHOD

CROSS-REFERENCE TO RELATED APPLICATIONS

This application claims the benefit of and priority to U.S. Provisional Application No. 60/097,903, filed Aug. 26, 1998, by Applicant Milburn Emile Dupré.

STATEMENT REGARDING FEDERALLY SPONSORED RESEARCH

Not applicable.

BACKGROUND OF THE INVENTION

1. Field of the Invention

This invention pertains to barrier fluid seals, pumps and compressors, and more particularly to a barrier fluid seal assembly for a reciprocating rod, a reciprocating pump with the seal assembly and a method for operating reciprocating pumps.

2. Description of the Related Art

Moving shafts, such as reciprocating rods, frequently require a seal around the shaft. For example, reciprocating, plunger-type pumps and compressors require a seal around the plunger. Reciprocating pumps used in high-pressure applications, such as for chemical injection into a high-pressure vessel, have seals for containing a process fluid to be pumped, but it has been common to have some leakage past the seals. Such leakage is wasteful, and it leads to premature failure of the seals as well as being a source of pollution.

U.S. Pat. No. 5,746,435, issued to Arbuckle, discloses a dual seal barrier fluid leakage control method for a rotary pump. Arbuckle discloses a method for controlling leakage of a barrier fluid from a dual seal assembly for a rotary pump employing a barrier fluid supply arrangement connected to a barrier fluid chamber of the dual seal assembly. A pressure intensifier mechanism operates to maintain the pressure of the barrier fluid at a preset level above the pressure of a process fluid. An impeller rotates with a rotary drive shaft for circulating barrier fluid through a heat exchanger for cooling the barrier fluid. However, a reciprocating rod, pump or compressor does not have a rotary drive shaft for circulating barrier fluid.

A further problem with a reciprocating pump is that the discharge pressure spikes upward as the pump discharges process fluid and then falls off as a plunger within the pump retracts to repeat the pumping cycle. Unsteady cyclic pressure and flow adversely impacts process operations. U.S. Pat. No. 4,611,973, issued to Birdwell, discloses a mud pump comprised of plural cylinder pumping units, each cylinder unit consisting of a pumping compression chamber and two or more hydraulic driven expansion chambers. One or more expansion chambers are employed to drive a pumping plunger to cause fluid to be pumped through the compression chamber. This system is said to eliminate large pressure surges, but it allows small pressure surges. However, in some applications, such as very high-pressure chemical injection, such pressure surges are undesirable.

SUMMARY OF THE INVENTION

A barrier fluid seal assembly is provided for a reciprocating rod. A housing has a bore in which the rod is received. The rod is sealed within the bore by first and second seals that are spaced apart, and a barrier fluid chamber is defined between the seals. The housing has an inlet opening into the barrier fluid chamber and an outlet opening from the barrier fluid chamber, and a pumping device is mounted to the rod for pumping a barrier fluid through the barrier fluid chamber.

In one embodiment, the housing has first and second inlet ports and first and second outlet ports providing openings into the barrier fluid chamber. A pumping ring is fixed to the reciprocating rod between the first and second inlet ports. The pumping ring draws barrier fluid into the barrier fluid chamber through one of the inlet ports and at the same time discharges an equal amount of barrier fluid through one of the outlet ports.

A reciprocating pump incorporates a barrier fluid seal assembly in one embodiment. The reciprocating pump has a plunger received in a bore in a body, and a pumping ring is secured to the plunger for pumping barrier fluid through a barrier fluid circuit. A barrier fluid pump can be included for maintaining a desired pressure in the barrier fluid circuit, such desired pressure preferably being greater than a process discharge pressure for the reciprocating pump. In one embodiment the barrier fluid pump is a plunger-type, reciprocating pump driven by a hydraulic cylinder. The hydraulic cylinder receives a common hydraulic fluid as is used for a driver for the reciprocating pump. In this embodiment, the barrier fluid pump provides pressure amplification for insuring that the pressure of the barrier fluid is greater than the process discharge pressure.

A method of operating two or more hydraulically-driven, reciprocating pumping cylinders provides smooth, bumpless transfer of pumping from a first pumping cylinder to a second pumping cylinder. A motion controller is used for reciprocating a plunger in each pumping cylinder. The motion controller is used in a control system for compressing a liquid process fluid in the first pumping cylinder before a plunger in the second pumping cylinder reaches the end of its stroke.

A hand-off of pumping from the second pumping cylinder to the first pumping cylinder occurs when the plunger in the second pumping cylinder reaches the end of its stroke. A total rate of travel of plungers in the first and second pumping cylinders is preferably determined and preferably held constant prior to a hand-off of pumping from one pumping cylinder to another pumping cylinder. In this case, the rate of travel of the plunger in the cylinder beginning its pumping stroke is increased while the rate of travel of the plunger in the cylinder that is ending its pumping stroke is decreased an equal amount so that the total plunger speed remains constant.

BRIEF DESCRIPTION OF THE DRAWINGS

The invention is more fully described below with reference to the accompanying drawings, in which:

FIGS. 6A, 6B, and 6C are an example of control logic for implementing bumpless transfer of pumping from a pumping cylinder A to a pumping cylinder B.

DETAILED DESCRIPTION OF INVENTION

Figure 1:
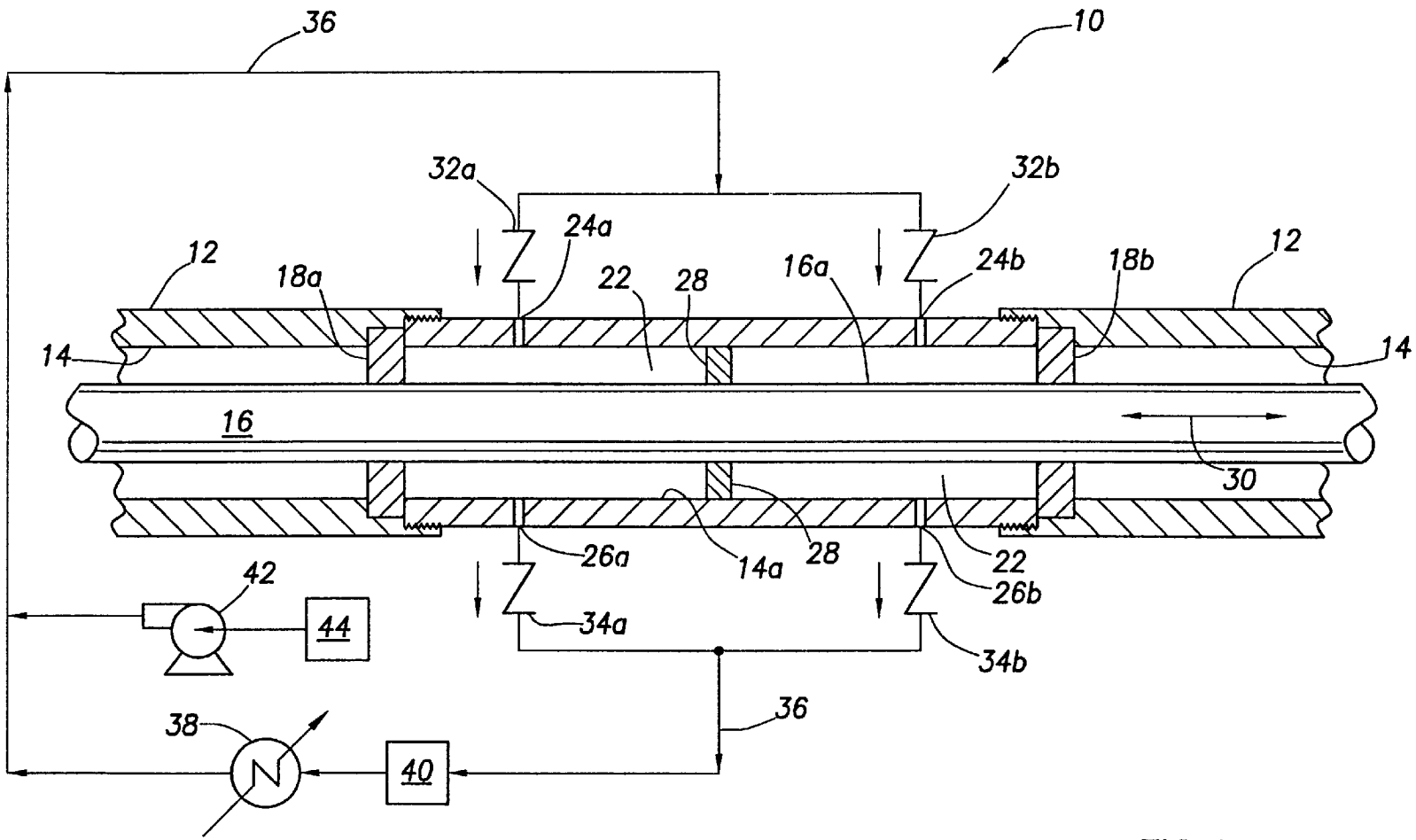
FIG. 1 is a cross-section of a barrier fluid seal assembly according to the present invention.

With reference to FIG. 1, a barrier fluid seal assembly 10 is illustrated in cross section. A body 12 has a bore 14, and a rod 16 is received in bore 14. A first seal 18*a* and a second seal 18*b* provide a seal around rod 16 within bore 14. A barrier fluid chamber 22 is defined within bore 14 between seals 18*a* and 18*b* as an annular space around rod 16. Body 12 has first and second inlet ports 24*a* and 24*b*, respectively, providing ingress openings for receiving a process-compatible barrier fluid into chamber 22. Body 12 also has first and second outlet ports 26*a* and 26*b*, respectively, providing egress openings through which the barrier fluid can discharge from chamber 22.

A pumping device 28 is mounted to rod 16 for pumping the barrier fluid within chamber 22. In this embodiment rod 16 moves back and forth as indicated by arrow 30, and pumping device 28 is a ring or flange sealingly fixed about the circumference of rod 16. Body 12 and bore 14 are cylindrical in shape, and bore 14 is defined by a surface 14*a*. Pumping device 28 extends radially from rod 16 to approximately surface 14*a* so that pumping device 28 provides essentially a seal between an outer surface 16*a* of rod 16 and surface 14*a* of bore 14.

As rod 16 moves to the right, as viewed in FIG. 1, barrier fluid is drawn into barrier fluid chamber 22 through first inlet port 24*a*. As pumping device 28 moves to the right, a slight suction or vacuum is created at first inlet port 24*a*, which draws barrier fluid into chamber 22 through a check valve 32*a*. Also as pumping device 28 moves to the right, barrier fluid is discharged through second outlet port 26*b*. A check valve 32*b* prevents barrier fluid from flowing out of chamber 22 through second inlet port 24*b*. A check valve 34*a* prevents barrier fluid from flowing into chamber 22 through first outlet port 26*a* as pumping device 28 moves to the right.

As rod 16 moves to the left, as viewed in FIG. 1, barrier fluid is drawn into barrier fluid chamber 22 by pumping device 28 through second inlet port 24*b*, as a slight vacuum is created at second inlet port 24*b*. Barrier fluid is drawn into chamber 22 through check valve 32*b* as rod 16 moves to the left. Also as pumping device 28 moves to the left, barrier fluid is discharged through first outlet port 26*a* and then through check valve 34*a*. A check valve 34*b* prevents barrier fluid from flowing into chamber 22 through second outlet port 26*b* as pumping device 28 moves to the left.

Bore 14 and rod 16 each have a constant diameter within barrier fluid chamber 22 between first and second seals 18*a* and 18*b*, respectively. As pumping device 28 strokes to the right, a certain amount of barrier fluid is drawn into barrier fluid chamber 22 through inlet port 24*a* (FIG. 1). An equal amount of barrier fluid is discharged through outlet port 26*b* as pumping device 28 strokes to the right. Thus, as pumping device 28 strokes back and forth, or up and down as the case may be, a certain amount of barrier fluid is drawn into chamber 22, while an equal amount of barrier fluid is discharged from chamber 22. The amount of barrier fluid in chamber 22 remains constant.

Pumping device 28 thus pumps barrier fluid into and out of barrier fluid chamber 22 as rod 16 strokes back and forth. The pressure of the barrier fluid in chamber 22 is maintained higher than on the other side of seals 18*a* and 18*b*. Consequently, there is a pressure drop across seals 18*a* and 18*b* with the higher pressure being within barrier fluid chamber 22. If there is leakage between rod 16 and seals 18*a* and 18*b*, then the barrier fluid tends to leak out of chamber 22 past seals 18*a* and 18*b*, which flushes and cleans seals 18*a* and 18*b*. Seals 18*a* and 18*b* thus last longer than may otherwise be possible.

Seals 18*a* and 18*b* fit tightly around rod 16, particularly if seals 18*a* and 18*b* are mechanical seals. As rod 16 slides within seals 18*a* and 18*b*, heat is generated due to friction, which heats the barrier fluid in chamber 22. A barrier fluid circuit 36 provides a closed loop through which barrier fluid flows from outlet ports 26*a* and 26*b* to inlet ports 24*a* and 24*b* due to the pumping action of pumping device 28. A heat exchanger 38 is included in barrier fluid circuit 36 for removing heat from the barrier fluid, and a filter 40 keeps the barrier fluid clean and free from abrasive particulate matter.

Pressure is maintained in barrier fluid circuit 36 by a pump 42, which provides a make-up of barrier fluid from a reservoir 44 of barrier fluid. A control system (not shown) can be provided for maintaining the barrier fluid in barrier fluid circuit 36 at a desired pressure for maintaining a desired differential pressure across seals 18*a* and 18*b*. Thus, the barrier fluid is pumped through circuit 36 by pumping device 28, while pump 42 maintains a desired pressure in circuit 36 and makes up for any loss of barrier fluid due to leakage past seals 18*a* and 18*b*. As the barrier fluid flows through circuit 36, heat exchanger 38 maintains a desired temperature, and filter 40 filters out particulate matter that would otherwise cause wear at the seal between rod 16 and seals 18*a* and 18*b*.

Barrier fluid seal assembly 10 in FIG. 1 can be used in a variety of applications. Seal assembly 10 can be used for providing a long-lasting seal arrangement for sealing around reciprocating rod 16 within bore 14 of body 12. Examples of reciprocating rod applications requiring a seal around the rod include plunger-type pumps, such as chemical-injection pumps and mud pumps used in drilling oil and gas wells, reciprocating compressors, and lift pumps that have a stuffing box and a reciprocating rod for pumping oil out of the ground. Various applications for barrier fluid seal assembly 10 exist, and a few such applications, as well as examples of seals, are described in U.S. patents having the following numbers: U.S. Pat. Nos. 5,639,218; 5,398,944; 4,611,973; 4,598,630; 4,579,350; 4,537,422; 4,478,423; and 4,229,011.

Reciprocating Pump

Figure 2:
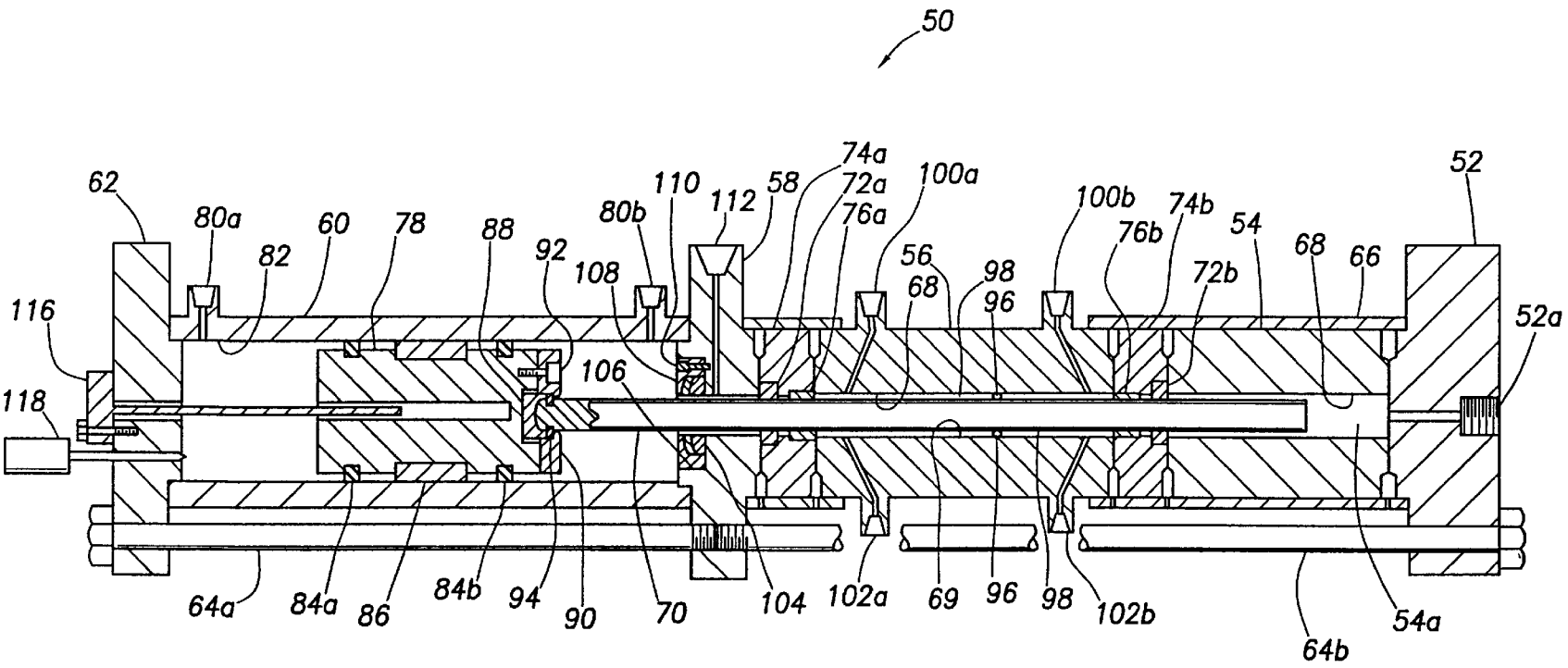
FIG. 2 is a cross-section of a reciprocating pump according to the present invention.

With reference to FIG. 2, one embodiment of the present invention is illustrated in a schematic cross-section of a plunger-type, reciprocating pump 50 for high-pressure applications. One skilled in this art is familiar with metering pumps, such as provided by McCartney Manufacturing Company, Inc. of Baxter Springs, Kansas in their Series PMP and PMH pumps.

Pump 50 includes a process cylinder head 52, a process cylinder 54, a barrier fluid cylinder 56, a dutchman 58, a hydraulic cylinder 60, and a hydraulic cylinder head 62. Tie rods 64*a* and 64*b* hold pump 50 together. Process cylinder 54 is received in a process cylinder sleeve guide 66, which is secured to process cylinder head 52.

Process cylinder 54, barrier cylinder 56, dutchman 58, and hydraulic cylinder 60 each have a common bore 68, and a plunger 70 is received in bore 68 (FIG. 2). Plunger 70 is sealed with high pressure packing seals 72*a* and 72*b*, which are selected to have a suitable materials compatibility. Packing seal 72*a* is received in a packing cup 74*a*, and packing seal 72*b* is received in a packing cup 74*b*. Guide bushings 76*a* and 76*b* are received in packing cups 74*a* and 74*b*, respectively.

A hydraulic piston 78 is received in hydraulic cylinder 60 and is attached to plunger 70 for providing a reciprocating or back and forth motion to plunger 70. Hydraulic cylinder 60 has hydraulic fluid ports 80*a* and 80*b* through which hydraulic fluid flows in and out for moving hydraulic piston 78 back and forth. Hydraulic cylinder 60 has a bore 82, and hydraulic piston 78 is sealed within bore 82 by piston rings 84*a* and 84*b*. A rider band 86 provides a wear surface for hydraulic piston 78. Hydraulic piston 78 has a plunger cup 88, and a plunger cup retainer 90 is fastened to hydraulic cylinder 78 using bolts 92. Plunger 70 is connected to hydraulic cylinder 78 using plunger retainer clips 94. Consequently, as hydraulic cylinder 78 reciprocates, so does plunger 70.

Bore 68 in process cylinder 54 provides a process fluid chamber 54*a*. An opening 52*a* in process cylinder head 52 provides a port for process fluid to flow into and out of process fluid chamber 54*a*. As hydraulic piston 78 retracts, it causes plunger 70 to retract, which draws process fluid into process fluid chamber 54*a*. As hydraulic piston 78 pushes forward, plunger 70 pumps the process fluid out of process fluid chamber 54*a* through opening 52*a*. Check valves (not shown) are arranged such that opening 52*a* serves as both an inlet and an outlet. Process fluid is thus pumped using hydraulic fluid flowing into and out of bore 82 through openings 80*a* and 80*b* to move hydraulic piston 78 back and forth.

Pump 50 can be used to discharge process fluid at a very high pressure, such as about 40,000 pounds per square inch (psi), and pump 50 can operate in a range from about 100 psi to about 100,000 psi in process fluid chamber 54*a*. It is not necessary for the hydraulic fluid in bore 82 to operate at as high a pressure as the process fluid in process fluid chamber 54*a* because pressure amplification is achieved since the cross-sectional area of bore 82 is greater than the cross-sectional area of plunger 70. Since hydraulic piston 78 is sealed by piston rings 84*a* and 84*b* within bore 82 of hydraulic cylinder 60, the force that can be imparted on plunger 70 by hydraulic piston 78 is proportional to the cross-sectional area of bore 82 (FIG. 2).

The ratio of the cross-sectional area of bore 82 to the cross-sectional area of plunger 70 provides a multiplier for determining the pressure amplification in process fluid chamber 54*a* as a function of hydraulic fluid pressure within bore 82. The cross-sectional area of plunger 70 is used rather than the cross-sectional area of bore 68 because plunger 70 is not sealed within bore 68, but rather is sealed by high pressure packing seal 72*b*.

A barrier fluid seal assembly is provided by barrier fluid cylinder 56 and high pressure packing seals 72*a* and 72*b*. A pumping ring 96 is attached to plunger 70. Pumping ring 96 can be, for example, a torus, a doughnut-shaped ring, or a flange having the shape of a washer, although any suitable shape is contemplated. Pumping ring 96 can be affixed to plunger 70 by any suitable means, such as by welding or bonding or by a tight, friction fit. Pumping ring 96 fits snugly within bore 68 and seals between plunger 70 and a wall 69 defining bore 68. Thus, pumping ring 96 effectively provides a wiper seal that strokes back and forth within barrier fluid cylinder 56.

A barrier fluid chamber 98 is defined within bore 68 as an annular space between plunger 70 and wall 69 between packing seals 72*a* and 72*b*. First and second inlets 100*a* and 100*b*, respectively, provide openings for receiving a barrier fluid into barrier fluid chamber 98. First and second outlets 102*a* and 102*b*, respectively, provide openings for barrier fluid to discharge from barrier fluid chamber 98 (FIG. 2).

Barrier fluid chamber 98 is an annular space between concentric circles defined by wall 69 and an outer surface of plunger 70. With reference to the view in FIG. 2, as plunger 70 moves to the right, barrier fluid is drawn into barrier fluid chamber 98 through inlet opening 100*a*. At the same time, as plunger 70 moves to the right, an equal amount of barrier fluid is discharged from barrier fluid chamber 98 through outlet opening 102*b*.

Pumping ring 96 provides the motive force for pumping barrier fluid through barrier fluid chamber 98. As plunger 70 moves to the left, pumping ring 96 creates a suction at inlet opening 100*b*, which draws barrier fluid into barrier fluid chamber 98. As plunger 70 strokes to the left, pumping ring 96 discharges barrier fluid through outlet opening 102*a*. Check valves (not shown) provide for one-way flow into inlet openings 100*a* and 100*b* and out of outlet openings 102*a* and 102*b*, respectively.

The barrier fluid in barrier fluid chamber 98 is maintained at a higher pressure by an external pump (not shown) than is process fluid in process fluid chamber 54*a*. The process fluid may be toxic, corrosive or erosive, which in any case, causes degradation of high-pressure packing seal 72*b* (FIG. 2). It is thus desirable to prevent the entry of process fluid into barrier fluid chamber 98. If there is any leakage between high pressure packing seal 72*b* and plunger 70, which typically there is, then it is preferable and desirable for barrier fluid to flow from barrier fluid chamber 98 into process fluid chamber 54*a*. The barrier fluid is preferably nontoxic and nonhazardous and thus has a less deleterious effect on high-pressure packing seal 72*b* than would the process fluid. Consequently, high-pressure packing seal 72*b* lasts longer than it would without having barrier fluid maintained at a higher pressure than the process fluid.

Hydraulic cylinder 60 is sealed to dutchman 58 using a hydraulic oil packing 104. Dutchman 58 has a hydraulic oil packing cup 106. A packing retainer 108 and bolts 110 hold packing 104 in position for preventing the leakage of hydraulic fluid from bore 82 into dutchman 58. Dutchman 58 has a vent 112 for releasing any hydraulic fluid that may leak past packing 104.

A proximity probe 116 indicates the position of hydraulic piston 78 and is used to calculate the velocity of hydraulic piston 78, which can be used for maintaining a desired pumping rate of process fluid through opening 52*a* (FIG. 2). By controlling the speed of piston 78, and hence of plunger 70, the discharge flow rate of process fluid can be controlled.

A pressure transducer 118 is provided for monitoring the pressure of hydraulic fluid in bore 82 of hydraulic cylinder 60. Since there is a predictable pressure amplification determined by the ratio of the cross-sectional area of bore 82 to the cross-sectional area plunger 70, the pressure of process fluid in process fluid chamber 54*a* can be calculated as a function of hydraulic fluid pressure as measured by pressure transducer 118. With a controller (not shown), proximity probe 116 and pressure transducer 118, the pressure of process fluid in process fluid chamber 54*a*, as well as the rate of change of pressure in process fluid chamber 54*a*, can be determined by calculation. The significance of process fluid pressure and flow control is discussed further below.

In the embodiment described in FIG. 2, the driver for plunger 70 is hydraulic cylinder 60. However, other prime movers can be used to reciprocate plunger 70. For example, a crankshaft can be used to convert rotating motion to reciprocating motion, which then allows the use of drivers such as an electric motor, a steam or gas turbine, or a diesel, natural gas or gasoline engine.

Pumping Unit

Figure 3:
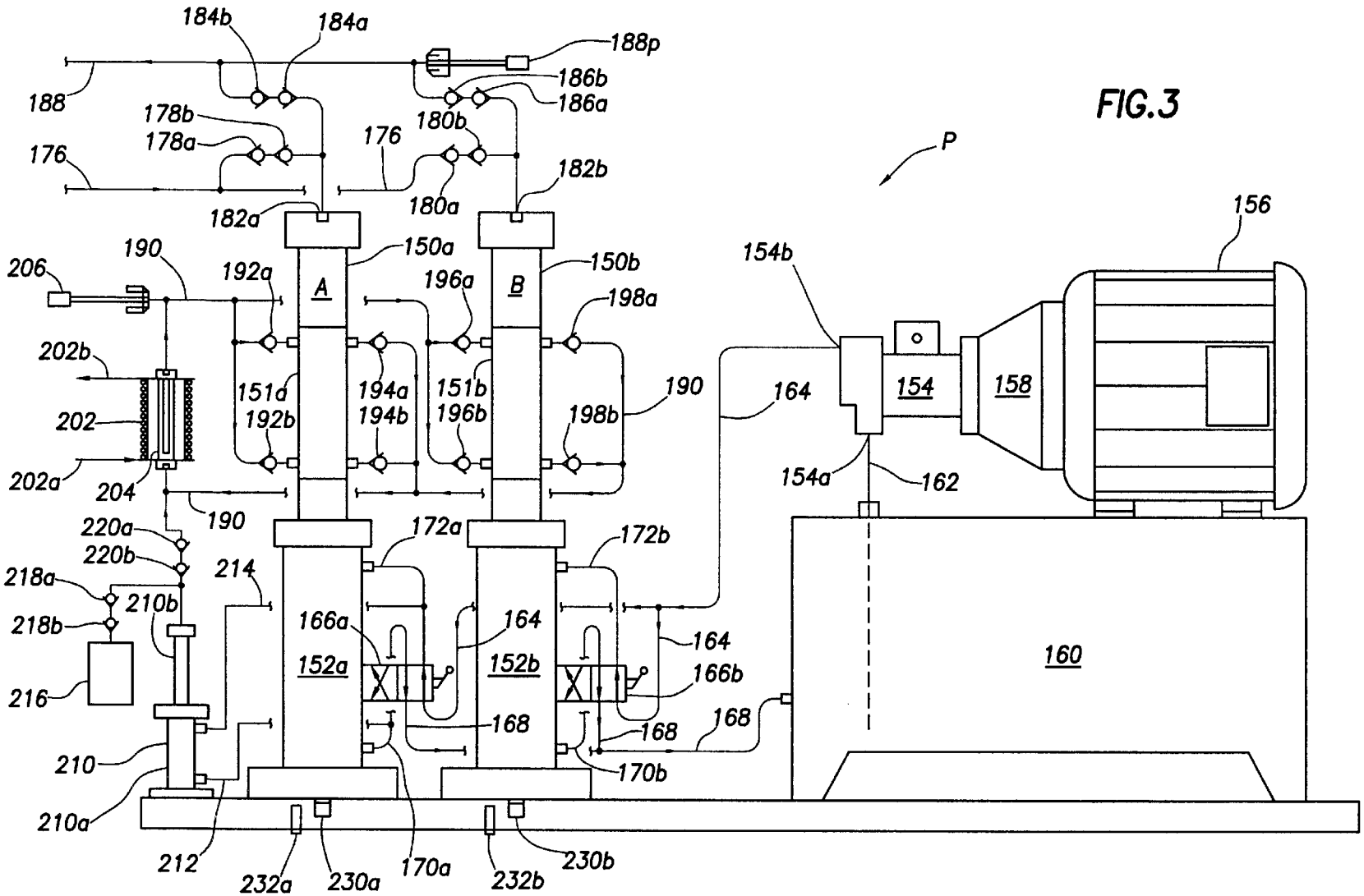
FIG. 3 is a process schematic of a pumping unit according to the present invention.

Turning now to FIG. 3, a pumping unit P is illustrated schematically. Pumping unit P includes a pump cylinder A and a pump cylinder B, which have components and operate as described with reference to pump 50 in FIG. 2. Pump cylinders A and B include process cylinders 150*a* and 150*b*, respectively, and hydraulic cylinders 152*a* and 152*b*, respectively. A hydraulic fluid pump 154 is driven by an electric motor 156 through a drive adapter 158. Hydraulic fluid is drawn from a reservoir 160 through a line 162 into a suction 154*a* of hydraulic fluid pump 154.

Hydraulic fluid pump 154 has a discharge 154*b* and discharges hydraulic fluid through a line 164. Line 164 is typically stainless steel tubing and is used to deliver hydraulic fluid to servo-valves 166*a* and 166*b*. Hydraulic fluid is returned to reservoir 160 through line 168.

Servo-valves 166*a* and 166*b*, such as are available from HSC Controls, Inc., of Buffalo, New York, or from Schenck Pegasus of Troy, Michigan, deliver hydraulic fluid to hydraulic cylinders 152*a* and 152*b*, respectively, for reciprocating a hydraulic piston (not shown). For a power stroke for pumping process fluid, servo-valve 166*a* delivers hydraulic fluid to hydraulic cylinder 152*a* through a line 170*a*, and servo-valve 166*b* does the same through line 170*b*. To retract the hydraulic piston within hydraulic cylinder 152*a*, servo-valve 166*a* delivers hydraulic fluid through a retract oil line 172*a*, while servo-valve 166*b* does the same through line 172*b*. A hydraulic piston within hydraulic cylinders 152*a* and 152*b* is thus moved back and forth using hydraulic fluid and servo-valves 166*a* and 166*b*, respectively.

With continuing reference to FIG. 3, process fluid is supplied from a line 176 to process cylinder 150*a* through dual check valves 178*a* and 178*b*. Process fluid supply line 176 provides process fluid to process cylinder 150*b* through dual check valves 180*a* and 180*b*. On the retract stroke of the hydraulic piston (not shown), a plunger (not shown) is also retracted, which draws process fluid into process cylinders 150*a* and 150*b* through openings 182*a* and 182*b*, respectively. Pump cylinders A and B in FIG. 3 have internal operating components like those described for pump 50 in FIG. 2.

On the pumping stroke of the hydraulic piston in hydraulic cylinders 152*a* and 152*b*, the plunger in process cylinders 150*a* and 150*b*, respectively, discharge the process fluid through check valves 184*a* and 186*a*, respectively. Check valves 184*b* and 186*b* provide dual, series check valves for positive sealing. Process fluid is discharged through process fluid discharge line 188 (FIG. 3).

Pumping cylinders A and B have barrier fluid cylinders 151 a and 151*b*, which operate similar to barrier fluid cylinder 56 that was described for FIG. 2. A pumping device (not shown) is attached to the plunger (not shown) within pumping cylinders A and B. The pumping device is analogous to pumping ring 96 that was described with reference to FIG. 2. The pumping device pumps barrier fluid through a circuit 190 in FIG. 3. Barrier fluid flows into barrier fluid cylinder 151*a* through check valves 192*a* and 192*b*, and the barrier fluid discharges from barrier fluid chamber 151*a* through check valves 194*a* and 194*b*. Barrier fluid flows into barrier fluid cylinder 151*b* through check valves 196*a* and 196*b*. Barrier fluid is discharged from barrier fluid cylinder 151*b* through check valves 198*a* and 198*b*.

Inlet check valves 192*a*, 192*b*, 196*a*, and 196*b* are tied together in barrier fluid circuit 190. Outlet check valves 194*a*, 194*b*, 198*a*, and 198*b* are tied together on the discharge side of barrier circuit 190. Barrier fluid circuit 190 has a heat exchanger 202, such as a cooling jacket, for removing heat from the barrier fluid. Heat exchanger 202 has an inlet 202*a* and an outlet 202*b* for receiving and discharging a heat transfer fluid that is used to cool the barrier fluid. A filter element 204 is provided in barrier fluid circuit 190 for filtering particulate matter and solids from the barrier fluid.

A pressure and temperature sensor and transducer 206 provides for monitoring and/or control of the barrier fluid within barrier fluid circuit 190 (FIG. 3). The pressure of barrier fluid in barrier fluid circuit 190 is preferably held higher than the process discharge pressure in process fluid discharge line 188. Pressure/temperature sensor 206 can be coupled to a differential pressure indicator and controller (not shown) for maintaining the pressure of barrier fluid higher than the pressure of process fluid in line 188.

A pump 210 that is external to barrier fluid circuit 190 is used to maintain the pressure of barrier fluid within barrier fluid circuit 190 higher than the process pressure in process fluid discharge line 188. Although pump 210 can be a rotary pump driven by an electric motor or pump 210 can be any other suitable pumping apparatus, pump 210 is illustrated in FIG. 3 as a plunger-type, reciprocating pump. Further, servo-valve 166*a*, which is used for driving the hydraulic piston within hydraulic caylinder 152*a*, is also used for driving a hydraulic piston within a hydraulic cylinder 210*a* of pump 210. Hydraulic fluid for putting the piston within hydraulic cylinder 210*a* through a pumping stroke is supplied by line 212, which is in fluid communication with line 170*a*. Hydraulic fluid for the retract stroke is supplied through line 214, which is in fluid communication with line 172*a*.

Pump 210 is illustrated here as a single pump associated with servo-valve 166*a* (FIG. 3). However, an identical or similar pump 211 (not shown) can be associated with servo-valve 166*b*, which is associated with hydraulic cylinder 152*b*. As pump 210 is tied into lines 170*a* and 172*a*, pump 211 would be tied into lines 170*b* and 172*b*, respectively. By having a pump 210 and a pump 211, if, for example, a seal leak were to develop in one, the other would assist in maintaining a relatively constant barrier fluid pressure.

Pump 210 has a pumping cylinder 210b for pumping barrier fluid into barrier fluid circuit 190. A barrier fluid reservoir 216 provides a supply of barrier fluid for making up losses of barrier fluid in barrier fluid circuit 190. On a retract stroke, barrier fluid is drawn from reservoir 216 through check valves 218*a* and 218*b* into pumping cylinder 210*b*. On a pumping stroke, the barrier fluid is discharged from pumping cylinder 210*b* through check valves 220*a* and 220*b* into barrier fluid circuit 190.

Plunger-type, reciprocating pump 210 provides pressure intensification or amplification so that for a given hydraulic fluid pressure in lines 212 and 214, a predetermined pressure can be maintained in barrier fluid circuit 190. As was discussed above with reference to FIG. 2, the pressure of hydraulic fluid, the cross-sectional area of the hydraulic piston and the cross-sectional area of the plunger can be used to determine and predict the discharge pressure of the process fluid from the reciprocating pump. Thus, the discharge pressure of hydraulic pump 154 in FIG. 3 determines the process pressure in discharge line 188 for a given configuration of pumping cylinders A and B.

Similarly, hydraulic pump 154 determines the pressure of hydraulic fluid in lines 212 and 214 through servo-valve 166*a*. For a given sizing of the hydraulic piston and plunger in pump 210, the discharge pressure of barrier fluid through check valves 220*a* and 220*b* is determined. Consequently, by proper sizing of the hydraulic piston and the plunger in pump 210, the pressure of barrier fluid in barrier fluid circuit 190 can be maintained at a predetermined level above the pressure in process discharge line 188. In this manner, barrier fluid tends to leak into process fluid cylinders 150*a* and 150*b* from barrier fluid cylinders 151*a* and 151*b*, respectively. Thus, a positive differential pressure can be maintained across seals for barrier fluid cylinders 151*a* and 151*b* in FIG. 3, as was discussed above with reference to seals 72*a* and 72*b* in FIG. 2.

The need for complicated controls to insure that barrier fluid pressure is maintained higher than process fluid pressure is thus eliminated. Where a barrier fluid seal assembly is used for reciprocating pumps that are hydraulically driven, the same hydraulic fluid can be used for driving a reciprocating barrier fluid pump. For process fluid to be pumped, it is necessary for hydraulic fluid to reciprocate hydraulic pistons. If the hydraulic fluid is circulated as described with reference to FIG. 3, then pressure intensification or amplification in pump 210 can be used to ensure a barrier fluid pressure that is higher than the pressure of process fluid at openings 182*a* and 182*b* in pumping cylinders A and B, respectively.

Thus, a reliable mechanism is provided for insuring that barrier fluid pressure is maintained higher than process fluid pressure. Pumping unit P in FIG. 3 has been illustrated with a single barrier fluid circuit 190 and a single barrier fluid pump 210. However, separate barrier fluid circuits and separate barrier fluid pumps can be provided for pumping cylinders A and B.

Pumping Controls

A pumping unit may have as few as two pumping cylinders, such as pumping unit P in FIG. 3, or as many pumping cylinders as desired for a particular application. With reference to FIG. 3, a particular method of operating pumping unit P ensures a smooth flow rate of the process fluid in process fluid discharge line 188 and minor, or essentially negligible, fluctuations in the pressure and flow rate of the process fluid in process fluid discharge line 188. Smooth process fluid delivery is desirable because it allows more optimal operation of downstream equipment, such as a reactor receiving catalyst injection via pumping unit P, where flow and pressure fluctuations in the catalyst can cause substantial pressure, temperature and yield disturbances in the reactor.

Referred to as smooth pumping controls, smooth process fluid delivery is also desirable because it eliminates the need for snubbers to eliminate flow and pressure fluctuations in process discharge line 188. Snubbers would otherwise be required in process suction line 176 and/or in process discharge line 188.

Smooth pumping controls include cylinder pre-load controls. Cylinder preloading refers to the pressurization of the process fluid within the process cylinder just prior to the plunger starting to pump process fluid. Liquid process fluid may be compressible at very high pressures, such as over 10,000 psi, and the liquid process fluid may contain air bubbles or other non-condensable gases. It is desirable to preload or compress liquid process fluid prior to discharge into process discharge line 188, as such compression helps to minimize or eliminate flow and pressure disturbances in line 188 (FIG. 3).

Pre-loading controls are programmed via a controller, such as a programmable logic controller, a PLC, or a microprocessor. For example, assume the plunger in process cylinder A is moving at 1 inch per second and is pumping process fluid into process fluid discharge line 188. Process cylinder B is preparing to pump, and its plunger is moving in a direction opposite that of the plunger in process cylinder A. Referred to as a cycle, the cycle of process cylinder B begins by retraction of its plunger into a fully-retracted position. Servo-valve 166*b* delivers hydraulic fluid into hydraulic cylinder 152*b* via hydraulic line 172*b*.

The hydraulic piston in hydraulic cylinder 152*b* is thus retracted, which draws a fresh charge of process fluid into process cylinder 150*b* from process fluid supply line 176. Upon completion of the retraction stroke, servo-valve 166*b* directs hydraulic fluid through line 170*b* into hydraulic cylinder 152*b*, which pushes the hydraulic piston forward for a pumping stroke. The plunger and process cylinder 150*b* applies pressure to the process fluid, pre-loading the process fluid that is within the process fluid chamber in process cylinder 150*b*.

The pressure of the process fluid within process cylinder 150*b* is quickly ramped up to above about 80%, preferably above about 95%, of its ultimate discharge pressure, which is the pressure in process discharge line 188. However, the pressure of the process fluid in process cylinder 150*b* is not increased at this time to its ultimate discharge pressure. The pressure of the process fluid in process cylinder 150*b* is instead ramped up to, for example, about 97% of its ultimate discharge pressure.

With reference to FIG. 3, hydraulic cylinders 152*a* and 152*b* have pressure transducers 230*a* and 230*b*, respectively. Hydraulic cylinders 152*a* and 152*b* also have proximity probes 232*a* and 232*b*, respectively. These measuring devices were introduced as pressure sensor 118 and proximity probe 116 in FIG. 2. These measurements can be used in providing smooth pumping controls as described further below.

Again, the pressure of process fluid in process cylinder 150*b* is quickly ramped up to greater than about 80 or 85% of the ultimate discharge pressure, preferably above about 95%. Pressure transducer 230*b* is hydraulic cylinder 152*b* provides the pressure of hydraulic fluid, and the pressure of process fluid in pumping cylinder B can be calculated as a function of the pressure of hydraulic fluid in hydraulic cylinder 152*b*. After the pressure is quickly ramped up to above, for example, 85%–95% of the ultimate discharge pressure, the movement of the plunger in process cylinder 150*b* is slowed to a crawl.

If the normal rate of travel of a plunger is about one inch per second while pumping, then a crawl is a rate of travel of about 0.01 inches per second. Crawl speed is about the slowest speed at which a plunger can be controlled. The rate of travel of the plunger in process cylinder 150*b* is indicated by the rate of travel of the hydraulic piston in hydraulic cylinder 152*b*, which is measured by proximity probe 232*b*.

The pressure of hydraulic fluid in hydraulic cylinder 152*b* is monitored by pressure transducer 230*b*, and when the pressure indicated by pressure transducer 230*b* is no longer increasing, then pumping cylinders A and B are both pumping simultaneously (FIG. 3).

As the plunger in process cylinder 150*a* nears the end of its stroke, as indicated by proximity probe 232*a*, the rate of travel of the plunger in process cylinder 150*b* is decreased. As the rate of travel of the plunger in process cylinder 150*a* is decreased as it nears the end of its stroke, the rate of travel of the plunger in process cylinder 150*b* is increased an equal and opposite amount until the movement of the plunger in process cylinder 150*a* is zero, indicating that it has reached the end of its stroke.

A transition or hand-off has just occurred where pumping has been handed off from pumping cylinder A to pumping cylinder B. As the plunger is process cylinder 150*a* is at the end of its pumping stroke, it immediately begins a retraction stroke, where the plunger in process cylinder 150*a* is retracted by the hydraulic piston in hydraulic cylinder 152*a*.

The plunger in process cylinder 150*b* is pumping process fluid into process discharge line 188 as the plunger in process cylinder 150*a* is retracting and drawing in a fresh charge of process fluid through process fluid suction line 176 (FIG. 3). The plunger is pumping cylinder A fully retracts and then reverses into a pumping stroke while the plunger in pumping cylinder B continues to discharge process fluid into line 188. The plunger in pumping cylinder A is moved forward at a rate faster than its normal pumping rate to quickly pressurize the process fluid in pumping cylinder A to greater than about 85% of the ultimate discharge pressure. However, very little plunger movement occurs because the process fluid chamber in process cylinder 150*a* is filled with liquid process fluid.

The controller monitors the pressure of hydraulic fluid in hydraulic cylinder 152*a* using pressure transducer 230*a*. When this pressure stops increasing, as the plunger in pumping cylinder A is moving forward into its pumping stroke, then pumping cylinders A and B are pumping simultaneously. As the plunger in pumping cylinder B nears the end of its pumping stroke, as indicated by proximity probe 232*b*, the speed of the plunger in pumping cylinder B is decreased while the speed of the plunger in pumping cylinder A is increased an equal and opposite amount, which effects a smooth pumping hand-off from pumping cylinder B to pumping cylinder A.

Figure 4:
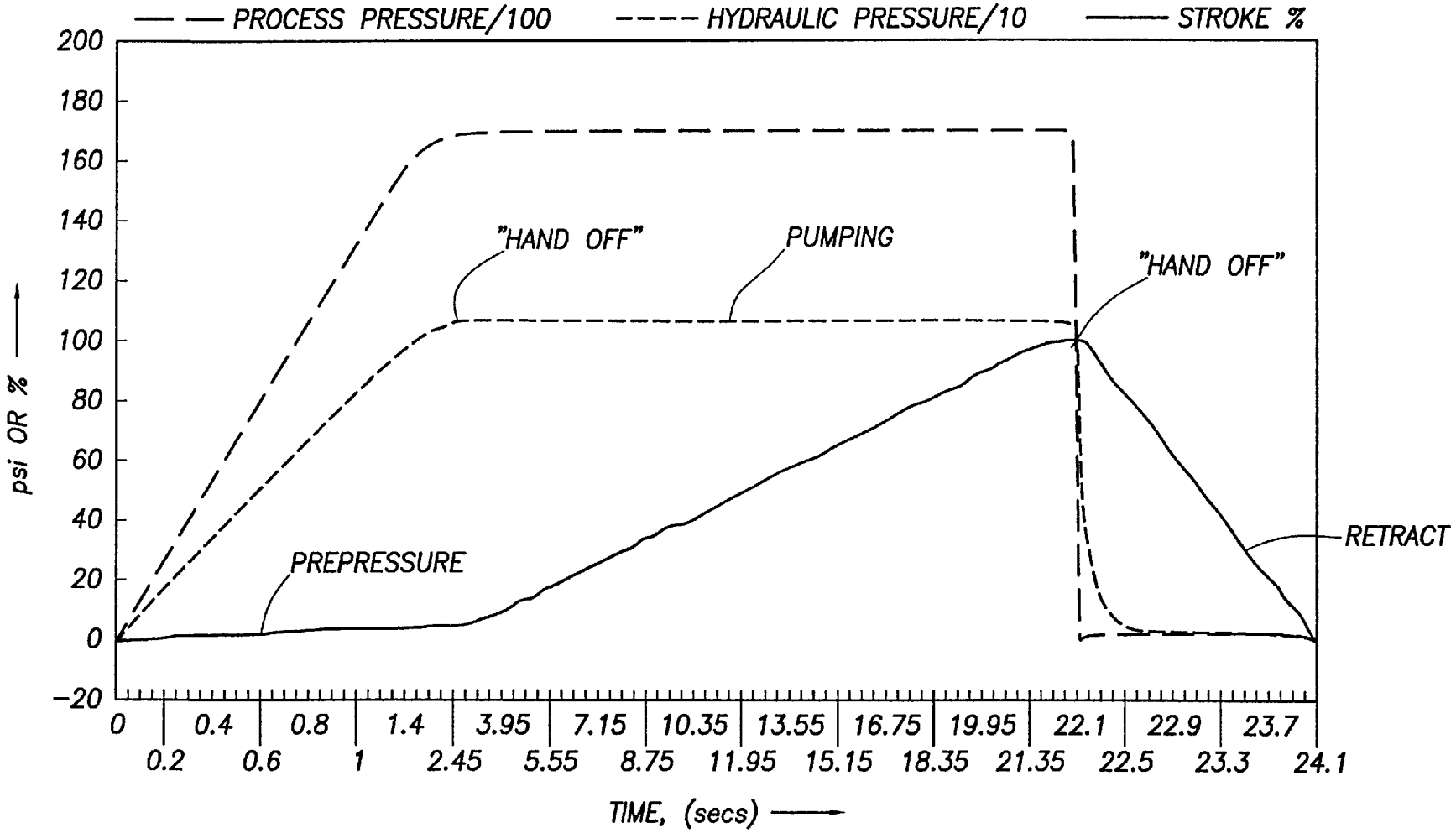
FIG. 4 is a graph illustrating a cycle for a pumping cylinder having smooth pumping controls according to the present invention.

Turning now to FIG. 4, the steps that a single pumping cylinder goes through are illustrated. Time in seconds is recorded on the horizontal axis, while either pressure in psi or percent of stroke is recorded on the vertical axis. The solid line provides the percent of stroke of a process plunger in a pumping cylinder. At a time equal to zero, the plunger is fully retracted and has traveled through zero percent of its full stroke. A fresh charge of process fluid has been drawn into process cylinder 150*a*.

FIG. 4 is a graphical illustration of the steps that process cylinder A in FIG. 3 goes through in one cycle. The dotted line indicates the pressure of hydraulic fluid in hydraulic cylinder 152*a*, as measured by pressure transducer 230*a*, but divided by ten in order to fit on the scale provided in FIG. 4. The dashed line indicates the pressure of process fluid in process cylinder 150*a* in psi divided by 100 in order to fit the scale in FIG. 4. With reference to FIG. 3, this process pressure is calculated as a function of the hydraulic fluid pressure measured by pressure transducer 230*a*, since the force exerted on the hydraulic piston is equal to the force exerted on the plunger, the pressure of the process fluid can be calculated using a ratio of cross-sectional areas as described above with reference to FIG. 2.

Using servo-valve 166*a*, the pressure of hydraulic fluid in hydraulic cylinder 152*a* is raised to pre-pressure or compress the process liquid in process cylinder 150*a*. This pre-pressure step occurs within about one second as illustrated in FIG. 4. The linear displacement of the plunger, as indicated by proximity probe 232*a* (FIG. 3), is negligible during the pre-pressure step. When the pressure of the process fluid in process cylinder 150*a* reaches about 95% of its ultimate discharge pressure, the rate of travel of the plunger is slowly increased at about as low a rate as is practical with the equipment and components in use. This crawl rate may be about 0.01 inch per second. This rate of travel is slowly increased while the rate of travel in pumping cylinder B (FIG. 3) is slowly decreased an equal and opposite amount.

With reference to FIG. 3, proximity probes 232*a* and 232*b* are used to calculate a flow rate of process fluid in process fluid discharge line 188. The rate of travel or speed of the plunger in pumping cylinder A is added to the speed of the plunger in pumping cylinder B to determine the flow rate of process fluid in discharge line 188. The sum of these speeds is held constant as one plunger nears the end of its pumping stroke. By holding the sum of these speeds constant, the flow rate of process fluid in line 188 is held constant, which minimizes any fluctuation in process fluid flow rate in discharge line 188.

Turning again to FIG. 4, a hand-off occurs after about two seconds when the plunger in pumping cylinder B (FIG. 3) reaches the end of its stroke. The stroke of the plunger in pumping cylinder A increases to 100% of its stroke at about 22 seconds. As indicated by the horizontal lines in FIG. 4 for process fluid pressure and hydraulic fluid pressure, pressure is maintained constant while the plunger moves through its pumping stroke. This constant pressure is achieved by monitoring the pressure of the hydraulic fluid in hydraulic cylinder 152*a* using pressure transducer 230*a* and manipulating servo-valve 166*a* to maintain a desired pressure.

As the plunger in pumping cylinder A reaches the end of its stroke, a hand-off occurs at about 22 seconds to pumping cylinder B (FIG. 4). The plunger in pumping cylinder A then quickly retracts as indicated by the steep, downwardly sloped line for the stroke between 22 seconds and 24 seconds (FIG. 4). Pressure in hydraulic cylinder 152*a* and in process cylinder 150*a* drops off to zero as the plunger in pumping cylinder A retracts. However, the pressure in process fluid discharge line 188 does not change because pumping cylinder B is pumping and there has been a smooth hand-off from pumping cylinder A to pumping cylinder B.

Figure 5:
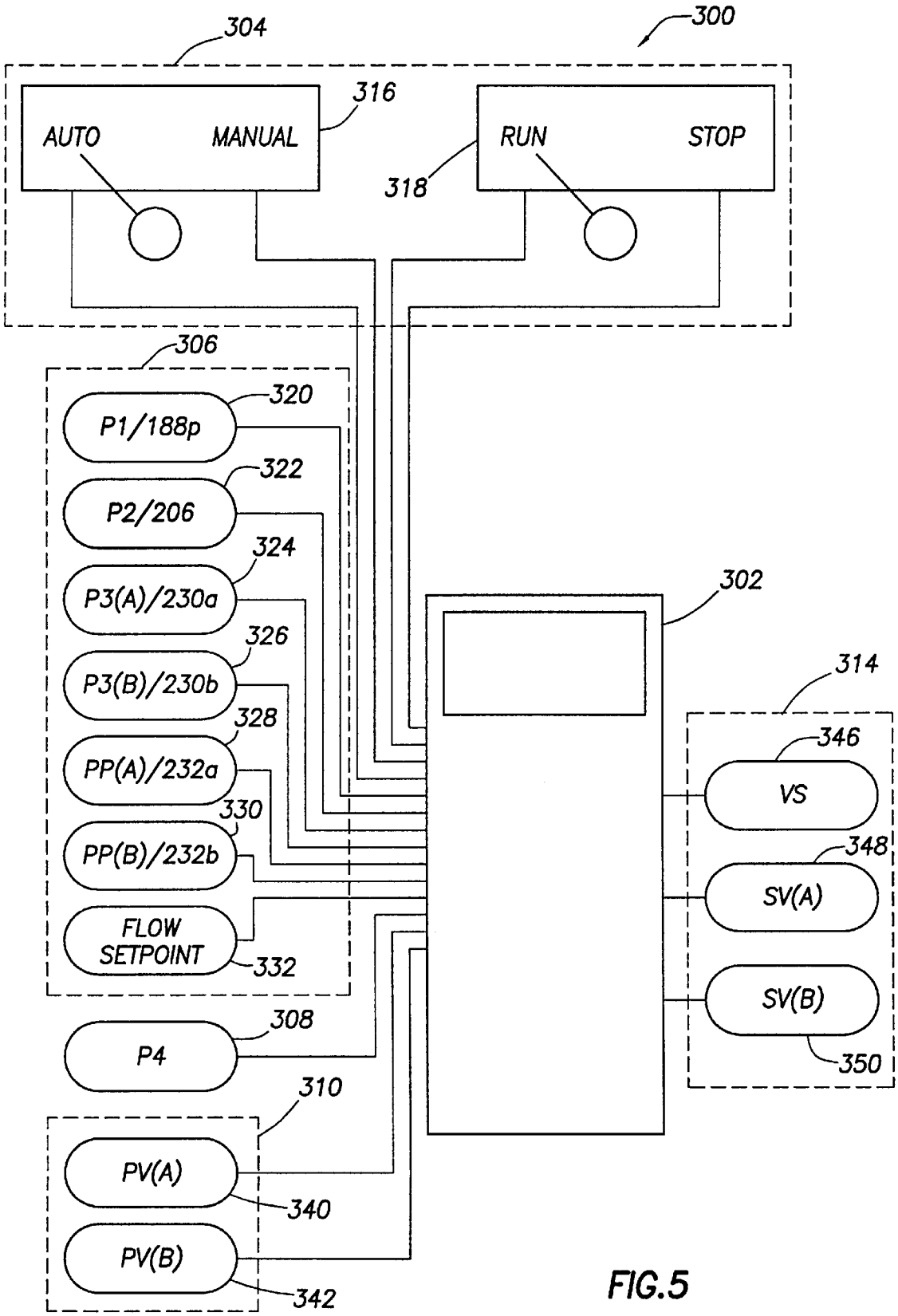
FIG. 5 is a schematic diagram of a control system for implementing smooth pumping controls.

Turning now to FIG. 5, a control schematic is illustrated for pumping unit P of FIG. 3. A control system 300 includes a controller 302 such as a PLC. Controller 302 receives field digital inputs 304, field analog inputs 306, digital input 308, and internal calculated inputs 310. Controller 302 uses these inputs in a control strategy, described below, and sends out outputs 314 for controlling pumping unit P in FIG. 3. Field digital inputs 304 include an auto/manual selector switch 316 and a run/stop selector switch 318. Field analog inputs 306 include an input 320 from a process fluid discharge pressure transducer 188p in process fluid discharge line 188 (FIG. 3). An input 322 is provided from pressure transducer 206, which measures the pressure of barrier fluid in barrier fluid circuit 190. Input 324 in FIG. 5 is a measure of hydraulic fluid pressure in hydraulic cylinder 152*a* as measured by pressure transducer 230*a* (FIG. 3). Input 326 similarly measures the pressure of hydraulic fluid in hydraulic cylinder 152*b* as indicated by pressure transducer 230*b*.

Input 328 in FIG. 5 provides an input indicating the position of the hydraulic piston in hydraulic cylinder 152*a* as measured by proximity probe 232*a* in FIG. 3. Input 330 similarly provides an input from proximity probe 232*b* for measuring the position of the hydraulic piston and the plunger in pumping cylinder B. Input 332 in FIG. 5 is a setpoint for a desired flow rate of process fluid in process fluid discharge line 188 in FIG. 3.

Input 308 in FIG. 5 is a setpoint for the pressure of barrier fluid in barrier fluid circuit 190. However, FIG. 5 differs from FIG. 3 in that control system 300 assumes that a stand-alone, electrically-driven barrier fluid pump is used rather than barrier fluid pump 210 in FIG. 3. In control system 300, the barrier fluid pump is driven by a variable speed motor, and the speed of the motor is manipulated to control pumping rate and thus the pressure of barrier fluid in the barrier fluid circuit.

Calculated inputs 310 in FIG. 5 include an input 340, which is a calculation of plunger velocity in pumping cylinder A in FIG. 3. Input 340 uses a measurement provided by proximity probe 232*a* in FIG. 3. An input 342 in FIG. 5 is a calculation of plunger velocity in pumping cylinder B, and the calculation is based on an input from proximity probe 232*b*.

Controller 302 in FIG. 5 produces outputs 314. Outputs 314 include output 346, which is an output to a variable speed motor driving a barrier fluid pump (not shown). Controller 302 determines an output 348 which is directed to servo-valve 166*a*, which drives the hydraulic piston in hydraulic cylinder 152*a* in FIG. 3. Likewise, controller 302 in FIG. 5 determines an output 350 that is directed to servo-valve 166*b*, which is used to manipulate the hydraulic piston in hydraulic cylinder 152*b* in FIG. 3.

Turning now to FIGS. 6A, 6B, and 6C an example of control logic used in controller 302 in FIG. 5 in set forth. FIGS. 6A, 6B, and 6C illustrate a control strategy for pumping unit P in FIG. 3, except rather than using barrier fluid pump 210, an electrically-driven barrier fluid pump is used. Further, the control strategy illustrated in FIGS. 6A, 6B, and 6C and control system 300 in FIG. 5 provide for inputs 324 and 326 (FIG. 5). Inputs 324 and 326 provide inputs to controller 302 from pressure transducers 230*a* and 230*b*, which measure hydraulic fluid pressure in hydraulic cylinders 152*a* and 152*b*, respectively.

As an alternative, a differential pressure that measures the difference between the hydraulic pressure in hydraulic cylinder 152*a* and the pressure of the hydraulic fluid in hydraulic cylinder 152*b* can be used in a control system for handing off pumping from one cylinder to another. Rather than monitoring for pressure stabilization in a hydraulic cylinder, this differential pressure can instead be an input to controller 302. Hand-off of pumping from one pumping cylinder to another pumping cylinder occurs when this differential pressure is zero. Two pressure transducers (230*a* and 230*b*) are thus replaced with one differential pressure transmitter, which is more reliable and eliminates measurement error, which can cause process fluid flow and/or pressure disturbances in process fluid discharge line 188 (FIG. 3). This differential pressure transmitter can be placed between hydraulic fluid inlets located at 230*a* and 230*b*, or this differential pressure transmitter can take its inputs from lines 170*a* and 170*b*, which deliver hydraulic fluid to hydraulic cylinders 152*a* and 152*b*, respectively, during the pumping stroke.

The foregoing disclosure and description of the invention are illustrative and explanatory thereof, and various changes in the details of the illustrated apparatus and construction and method of operation may be made without departing from the spirit of the invention.

What is claimed is:

1. A barrier fluid seal assembly for a reciprocating rod, comprising:

a body having a bore;

the rod being received in the bore;

first and second seals providing a seal around the rod, the first seal being spaced apart from the second seal;

a barrier fluid chamber being defined within the bore, around the rod and between the first and second seals;

the body having an inlet opening for receiving a barrier fluid into the chamber and an outlet opening for discharging the barrier fluid from the chamber; and a pumping device mounted to the rod for pumping the barrier fluid.

2. The barrier fluid seal assembly of claim 1, wherein the bore and the rod each have a circular cross-section, the bore being defined by a surface, and wherein the pumping device extends radially from the rod to a circumference adjacent to the surface of the bore.

3. The barrier fluid seal assembly of claim 1, wherein the inlet opening comprises first and second inlet ports spaced axially apart and the outlet opening comprises first and second outlet ports spaced axially apart.

4. The barrier fluid seal assembly of claim 3, wherein the pumping device is a pumping ring located between the first and second inlet ports.

5. The barrier fluid seal assembly of claim 4, wherein the pumping ring is fixedly secured to the rod about the circumference of the rod and extends radially from the rod, the rod reciprocating with a forward stroke and a backward stroke, and wherein during the forward stroke a quantity of barrier fluid is drawn into the chamber through the first inlet port and an essentially equal quantity of barrier fluid is discharged from the chamber through the second outlet port.

6. The barrier fluid seal assembly of claim 1, wherein the pumping device is a flange fixedly secured to the rod about the circumference of the rod, the flange extending radially from the rod.

7. A reciprocating pump, comprising:

a body having a bore;

a plunger received in the bore;

a driver for reciprocating the plunger;

first and second seals received in the bore of the body for providing a seal around the plunger, the first seal being spaced apart from the second seal; and a pumping ring secured to the plunger between the first and second seals for pumping a barrier fluid.

8. The reciprocating pump of claim 7, wherein the body has a first set of inlet and outlet ports for receiving and discharging the barrier fluid, respectively, located between the pumping ring and the first seal; and the body has a second set of inlet and outlet ports for receiving and discharging the barrier fluid, respectively, located between the pumping ring and the second seal.

9. The reciprocating pump of claim 8, further comprising a barrier fluid pump in fluid communication with the first and second barrier fluid inlet ports.

10. The reciprocating pump of claim 9, further comprising a barrier fluid reservoir in fluid communication with the first and second barrier fluid outlet ports, wherein the barrier fluid pump has a pump inlet in fluid communication with the reservoir for providing a closed-loop barrier fluid system for operation at a pressure sufficiently high to maintain a positive differential pressure across the first and second seals so that barrier fluid tends to flow between the plunger and the first and second seals for flushing the first and second seals.

11. The reciprocating pump of claim 7, wherein a barrier fluid chamber is defined within the bore, around the plunger and between the first and second seals, the body having a first set of inlet and outlet ports located between the pumping ring and the first seal and a second set of inlet and outlet ports located between the pumping ring and the second seal, and wherein the pumping ring is a flange extending radially from the plunger.

12. The reciprocating pump of claim 7, wherein the driver is a hydraulic cylinder.

13. The reciprocating pump of claim 12, wherein the body has a first set of inlet and outlet ports located between the pumping ring and the first seal and a second set of inlet and outlet ports located between the pumping ring and the second seal, further comprising a barrier fluid circuit providing a closed loop between the first set and the second set, and further comprising a barrier fluid pump in the barrier fluid circuit.

14. The reciprocating pump of claim 13, wherein the barrier fluid pump is a plunger-type reciprocating pump driven by a hydraulic fluid.

15. The reciprocating pump of claim 14, wherein the hydraulic fluid is also used to drive the hydraulic cylinder, and wherein the barrier fluid pump provides pressure amplification.

16. The reciprocating pump of claim 15, wherein the plunger provides a process discharge pressure, and wherein the pressure amplification ensures that the barrier fluid pump discharge pressure is greater than the process discharge pressure.

17. A reciprocating pump, comprising:

a process-cylinder head;

a process cylinder secured to the process-cylinder head, the process cylinder having an opening for ingress and egress of process fluid;

a barrier fluid cylinder secured to the process cylinder;

a dutchman secured to the barrier fluid cylinder;

a hydraulic cylinder secured to the dutchman;

a hydraulic-cylinder head secured to the hydraulic cylinder;

the process cylinder, the barrier fluid cylinder and the dutchman each having a bore in alignment with each other bore to provide a pump bore;

a plunger received in the pump bore;

first and second seals around the plunger;

the barrier fluid cylinder having first inlet and outlet ports proximate to the first seal and second inlet and outlet ports proximate to the second seal; and a ring secured radially about the circumference of the plunger, the ring being located between first inlet port and the second inlet port.

18. The reciprocating pump of claim 17, wherein the bore in the barrier fluid cylinder has an inside diameter, and wherein the ring has an outside diameter that is nearly as great as the inside diameter of the bore in the barrier fluid cylinder.

19. The reciprocating pump of claim 17, further comprising a barrier fluid circuit providing a closed loop between the first and second inlet ports and the first and second outlet ports, the barrier fluid circuit being external of the barrier fluid cylinder.

20. The reciprocating pump of claim 19, further comprising a barrier fluid pump in the barrier fluid circuit.

21. The reciprocating pump of claim 20, further comprising a filter in the barrier fluid circuit.

22. The reciprocating pump of claim 21, further comprising a heat exchanger in the barrier fluid circuit.

23. The reciprocating pump of claim 17, further comprising a reciprocating plunger-type barrier fluid pump driven by a hydraulic piston, a hydraulic fluid for driving the hydraulic piston, the hydraulic fluid also supplying the hydraulic cylinder that is secured to the dutchman, the barrier fluid pump being in fluid communication with the barrier fluid cylinder, and wherein the barrier fluid pump provides pressure intensification for ensuring that the pressure within the barrier fluid cylinder is greater than the pressure in the process cylinder.

24. The reciprocating pump of claim 19, further comprising:

a pressure sensor for determining the pressure in the barrier fluid circuit; and a pressure controller for maintaining the pressure in the barrier fluid circuit at a desired pressure.

25. The reciprocating pump of claim 17, further comprising:

a hydraulic piston disposed in the hydraulic cylinder that is secured to the dutchman, the hydraulic piston being secured to the plunger; and a proximity sensor for determining the position of the hydraulic piston.

26. The reciprocating pump of claim 25, further comprising:

a servo-valve for providing hydraulic fluid for reciprocating the hydraulic piston; and a controller, wherein the proximity sensor and the servo-valve are coupled to the controller for manipulating the position of the hydraulic piston.

27. The reciprocating rod pump of claim 26, further comprising a pressure sensor for measuring the pressure of fluid in the hydraulic cylinder, wherein the controller has logic for calculating a process fluid discharge pressure.

28. A method for controlling a reciprocating pump having two or more pumping cylinders, a pumping cylinder including a process fluid pumping cylinder and a hydraulic cylinder connected to the process fluid pumping cylinder and a plunger received within the process fluid pumping cylinder, the plunger being reciprocated by the hydraulic cylinder, the method comprising:

using a motion controller for regulating reciprocating motion;

using hydraulic cylinder pressure as an indicator for timing a transition from one process fluid pumping cylinder to another process fluid pumping cylinder; and compressing process fluid in the process fluid pumping cylinder prior to the transition to pumping in another cylinder.

29. The method of claim 28, wherein the motion controller includes a position transducer for determining the location of the plunger.

30. The method of claim 29, wherein the motion controller includes a servo-valve for providing hydraulic fluid to the hydraulic cylinder.

31. The method of claim 28, wherein the reciprocating pump has first and second pumping cylinders, the first and second pumping cylinders having first and second hydraulic cylinders, respectively, further comprising:

determining a differential pressure between the first and second hydraulic cylinders; and handing off pumping from the first pumping cylinder to the second pumping cylinder at about the time when the differential pressure is essentially zero.

32. The method of claim 28, further comprising increasing plunger speed in a first pumping cylinder while simultaneously decreasing plunger speed in a second pumping cylinder by an essentially equal and opposite amount for effecting a handoff of pumping from the second pumping cylinder to the first pumping cylinder.

33. The method of claim 28, wherein the reciprocating pump has first and second pumping cylinders, the first and second pumping cylinders having first and second plungers, respectively, further comprising:

determining plunger speed;

adding the plunger speed of the first plunger to the plunger speed of the second plunger to determine total plunger speed; and maintaining total plunger speed essentially constant prior to the hand-off of pumping with the first pumping cylinder to the second pumping cylinder.

34. The method of claim 28, further comprising:

providing a barrier fluid cylinder for each pumping cylinder; and pumping barrier fluid through the barrier fluid cylinder using a reciprocating motion provided by the plunger.

35. The method of claim 34, further comprising:

providing a plunger-type, reciprocating pump for pumping barrier fluid into a barrier fluid circuit; and maintaining the pressure of barrier fluid in the barrier fluid circuit higher than the pressure in the process fluid pumping cylinder by using a common hydraulic fluid for driving both the hydraulic cylinder and the barrier fluid pump, wherein the barrier fluid pump provides pressure amplification.

36. In a reciprocating pump having a pumping cylinder A and a pumping cylinder B, each cylinder including a process cylinder and a hydraulic cylinder secured to the process cylinder, a plunger received in the process cylinder and a hydraulic piston received in the hydraulic cylinder and secured to the plunger for reciprocating the plunger, a method for controlling the reciprocating pump comprising:

measuring the position of the hydraulic piston;

using a servo-valve in manipulating the position of the hydraulic piston;

pushing the plunger in cylinder A forward for pumping process fluid;

retracting the plunger in cylinder B to a fully retracted position while pushing the plunger in cylinder A forward;

increasing the pressure in process cylinder B at a first rate until the pressure in process cylinder B is at least about 85% of an ultimate process discharge pressure; and increasing the pressure in process cylinder B at a second rate until the ultimate process discharge pressure is achieved, the second rate being slower than the first rate.

37. The method of claim 36, further comprising decreasing the speed of the plunger in pumping cylinder A while increasing the speed of the plunger in pumping cylinder B until the plunger in pumping cylinder A reaches the end of its stroke, wherein the increase in speed of the plunger in pumping cylinder B is essentially equal and opposite to the decrease in speed of the plunger in pumping cylinder A until the movement of the plunger pumping cylinder A is essentially zero.

38. The method of claim 36, further comprising putting cylinder A through the steps described for pumping cylinder B while putting pumping cylinder B through the steps described for pumping cylinder A.

39. The method of claim 36, further comprising:

determining a differential pressure between the pressure in the hydraulic cylinder for pumping cylinder A and the pressure in the hydraulic cylinder for pumping cylinder B; and effecting a hand-off of pumping from pumping cylinder A to pumping cylinder B at about the time that the differential pressure is about zero.

40. The method of claim 36, further comprising:

determining the speed of the plungers in pumping cylinders A and B;

summing the plunger speeds to determine a combined plunger speed; and maintaining the combined plunger speed essentially constant prior to handing off pumping from pumping cylinder A to pumping cylinder B.

41. The method of claim 36, further comprising:

providing a barrier fluid cylinder for each pumping cylinder; and pumping barrier fluid through the barrier fluid cylinder using a reciprocating motion provided by the plunger.

* * * * *